US007837294B2

(12) United States Patent
Umeda

(10) Patent No.: US 7,837,294 B2
(45) Date of Patent: Nov. 23, 2010

(54) FLUID EJECTION APPARATUS

(75) Inventor: Takaichiro Umeda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 203 days.

(21) Appl. No.: 12/237,228

(22) Filed: Sep. 24, 2008

(65) Prior Publication Data

US 2009/0079771 A1 Mar. 26, 2009

(30) Foreign Application Priority Data

Sep. 26, 2007 (JP) ..... 2007-248323

(51) Int. Cl.
*B41J 2/165* (2006.01)
*B41J 2/175* (2006.01)
*B41J 2/19* (2006.01)

(52) U.S. Cl. ..... 347/30; 347/86; 347/92

(58) Field of Classification Search ..... 347/23, 347/24, 29, 30, 32, 86, 92
See application file for complete search history.

(56) References Cited

U.S. PATENT DOCUMENTS 5,812,155 A 9/1998 Seccombe
6,257,714 B1 7/2001 Seccombe
6,517,189 B2 2/2003 Ogawa et al.

FOREIGN PATENT DOCUMENTS

JP 2005199600 A 7/2005
JP 2006095868 A 4/2006

*Primary Examiner*—Shih-wen Hsieh
(74) *Attorney, Agent, or Firm*—Baker Botts, LLP.

(57) ABSTRACT

A fluid ejection apparatus includes a fluid ejection head comprising a nozzle through which fluid is ejected, a fluid supply passage through which fluid is supplied to the fluid ejection head, a suction device configured to draw fluid from the nozzle, and a movable member positioned within a predetermined portion of the fluid supply passage. The movable member has openings formed therethrough, and is configured to hold air bubbles therein. The movable member is further configured to move between a first position and a second position downstream of the first position in a fluid flowing direction. When the movable member is in the second position, the movable member partitions the predetermined portion of the fluid supply passage into a first space upstream of the movable member and a second space downstream of the movable member. Moreover, when the suction device transitions from an inactive state to an active state to draw fluid from the nozzle, the movable member moves from the first position to the second position and remains in the second position until the suction device transitions from the active state to the inactive state.

16 Claims, 6 Drawing Sheets

FLUID EJECTION APPARATUS

CROSS REFERENCE TO RELATED APPLICATION

The present application claims priority from Japanese Patent Application No. 2007-248323, filed on Sep. 26, 2007, the disclosure of which is incorporated herein by reference in its entirety.

BACKGROUND OF THE INVENTION

1. Field of the Invention

The present invention relates generally to fluid ejection apparatus configured to eject droplets of fluid.

2. Description of Related Art

Known fluid recording apparatus, such as inkjet recording apparatus, eject ink droplets from nozzles to recording mediums, such as recording sheets, to form images, such as text images, on the recording mediums. An inkjet recording apparatus includes a fluid ejection head, e.g., an inkjet head, having nozzles, and an ink cartridge which stores ink therein and is connected to the inkjet head. When ink is consumed as ink droplets are ejected from the nozzles of the inkjet head, ink is supplied from the ink cartridge to the inkjet head.

Air may enter a passage, e.g., a fluid supply passage, which connects the inkjet head to the ink cartridge, e.g., when the cartridge is replaced. If air in the fluid supply passage flows into the inkjet head together with ink, ink may not be properly ejected from the nozzles. Ink is suctioned from the nozzles of the inkjet head using a suction pump in order to discharge air that is present in a portion of the fluid supply passage upstream of the inkjet head in an ink flow direction together with ink.

For example, in one inkjet recording apparatus, such as the inkjet recording apparatus described in Japanese Laid-Open Patent Publication No. 2005-199600, the inkjet recording apparatus includes a damper configured to absorb fluctuations in ink pressures. The damper is positioned at a portion of a fluid supply passage between an inkjet head and an ink cartridge, and is positioned upstream of the inkjet head. When a predetermined amount of air is accumulated in the damper, ink is suctioned from the nozzles using a suction pump to discharge air in the damper via the nozzles.

Nevertheless, the inkjet recording apparatus has to suction ink using a relatively large suction force to discharge air attached to a corner portion of the fluid supply passage upstream of the inkjet head from the nozzles of the inkjet head. Consequently, in the known inkjet recording apparatus, a significant amount of ink is discharged via the nozzles when air is discharged via the nozzles.

SUMMARY OF THE INVENTION

Therefore, a need has arisen for fluid ejection apparatus which overcome these and other shortcomings of the related art. A technical advantage of the present invention is that when air is discharged from the fluid supply passage via the nozzles, the amount of ink also discharged via the nozzles is reduced.

According to an embodiment of the present invention, a fluid ejection apparatus comprises a fluid ejection head comprising a nozzle through which fluid is ejected, a fluid supply passage through which fluid is supplied to the fluid ejection head, a suction device configured to draw fluid from the nozzle, and a movable member positioned within a predetermined portion of the fluid supply passage. The movable member has at least one opening formed therethrough, and is configured to hold at least one air bubble therein. The movable member is further configured to move between a first position and a second position downstream of the first position in a fluid flowing direction. When the movable member is in the second position, the movable member partitions the predetermined portion of the fluid supply passage into a first space upstream of the movable member and a second space downstream of the movable member. Moreover, when the suction device transitions from an inactive state to an active state to draw ink from the nozzle, the movable member moves from the first position to the second position and remains in the second position until the suction device transitions from the active state to the inactive state.

Other objects, features, and advantages will be apparent to persons of ordinary skill in the art from the following detailed description of the invention and the accompanying drawings.

BRIEF DESCRIPTION OF THE DRAWINGS

For a more complete understanding of the invention, needs satisfied thereby, and the objects, features, and advantages thereof, reference now is made to the following description taken in connection with the accompanying drawings.

DETAILED DESCRIPTION OF EMBODIMENTS

Embodiments of the present invention and their features and technical advantages may be understood by referring to FIGS. 1-6C, like numerals being used for like corresponding portions in the various drawings.

Figure 1:
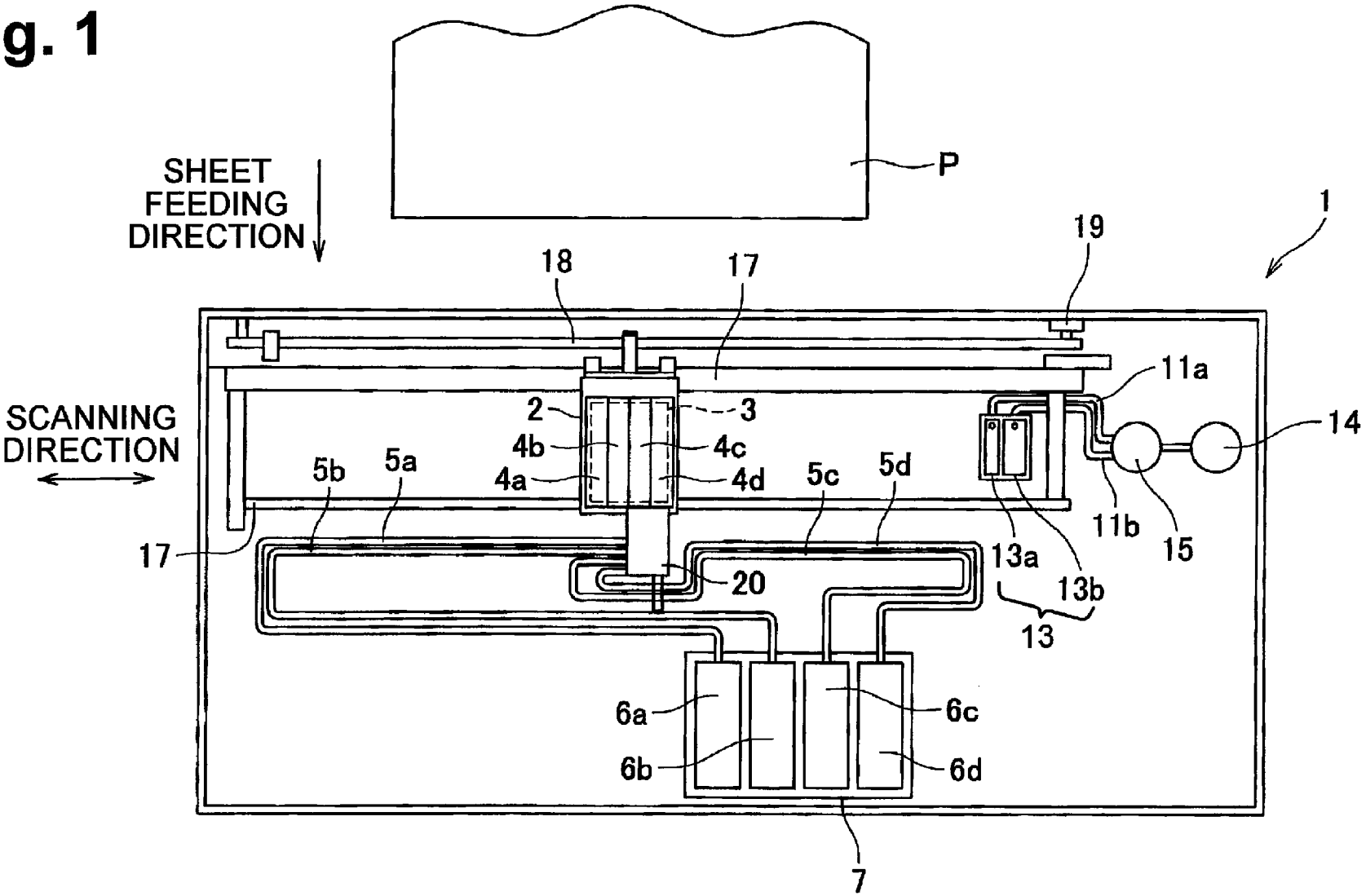
FIG. 1 is a plan view of a printer, according to an embodiment of the present invention.

Referring to FIG. 1, a fluid ejection device, e.g., a printer 1, according to an embodiment of the present invention, may form, e.g., print, a desired image, e.g., text, on recording mediums, e.g., recording sheets P, by ejecting droplets of fluid, e.g., ink, from a fluid ejection head, e.g., inkjet head 3, toward the recording sheets P.

Printer 1 may comprise a carriage 2, inkjet head 3, sub-tanks 4*a*-4*d*, which herein after collectively are referred to as sub-tank 4, ink cartridges 6*a*-6*d*, which herein after collectively are referred to as ink cartridge 6, a suction cap 13, and a suction device, e.g., a suction pump 14. Carriage 2 may be configured to reciprocate along one direction. Inkjet head 3 and sub-tank 4 may be mounted to carriage 2. Ink cartridge 6 may store ink therein. Suction cap 13 may be attached to a fluid ejection surface of inkjet head 3. Suction pump 14 may be connected to suction cap 13.

Carriage 2 may be configured to reciprocate along guide shafts 17 extending parallel to a scanning direction, e.g., a right-left direction in FIG. 1. Carriage 2 may be connected to an endless belt 18. When a carriage drive motor 19 drives endless belt 18, endless belt 18 may move carriage 2 in the right-left direction in FIG. 1.

Figure 2:
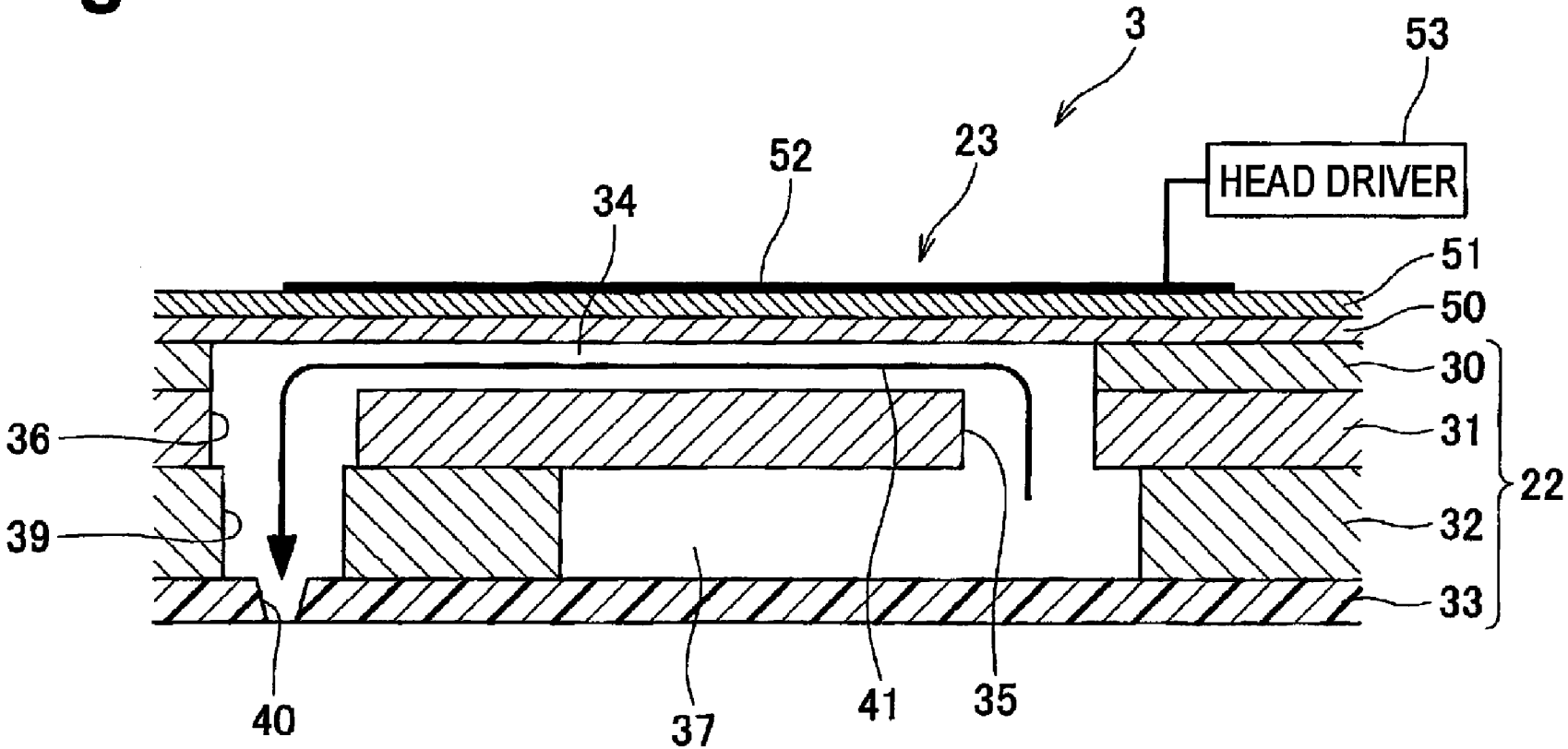
FIG. 2 is a vertical, sectional view of a portion of an inkjet head of the printer of FIG. 1, according to an embodiment of the present invention.

Inkjet head 3 and sub-tanks 4*a*-4*d* may be mounted on carriage 2. Inkjet head 3 may reciprocate in the scanning direction together with carriage 2. Inkjet head 3 may be configured to eject ink droplets from nozzles 40, as shown in FIG. 2, formed on a lower side of inkjet head 3 when inkjet head 3 is mounted on carriage 2. Recording sheets may be conveyed by a sheet feeding mechanism (not shown) in a sheet feeding direction, as indicated by the downwardly pointed arrow in FIG. 1. A desired text or an image or both may be formed on recording sheet P.

Sub-tanks 4*a*-4*d* may be positioned in a row in the scanning direction. A tube joint 20 may be integrally formed with sub-tanks 4*a*-4*d*. Each sub-tank 4*a*-4*d* may be coupled to a corresponding one of ink cartridges 6*a*-6*d*, respectively, via flexible tubes 5*a*-5*d*, respectively, connected to tube joint 20. Flexible tubes 5*a*-5*d* hereinafter collectively may be referred to as tube 5.

Figure 5:
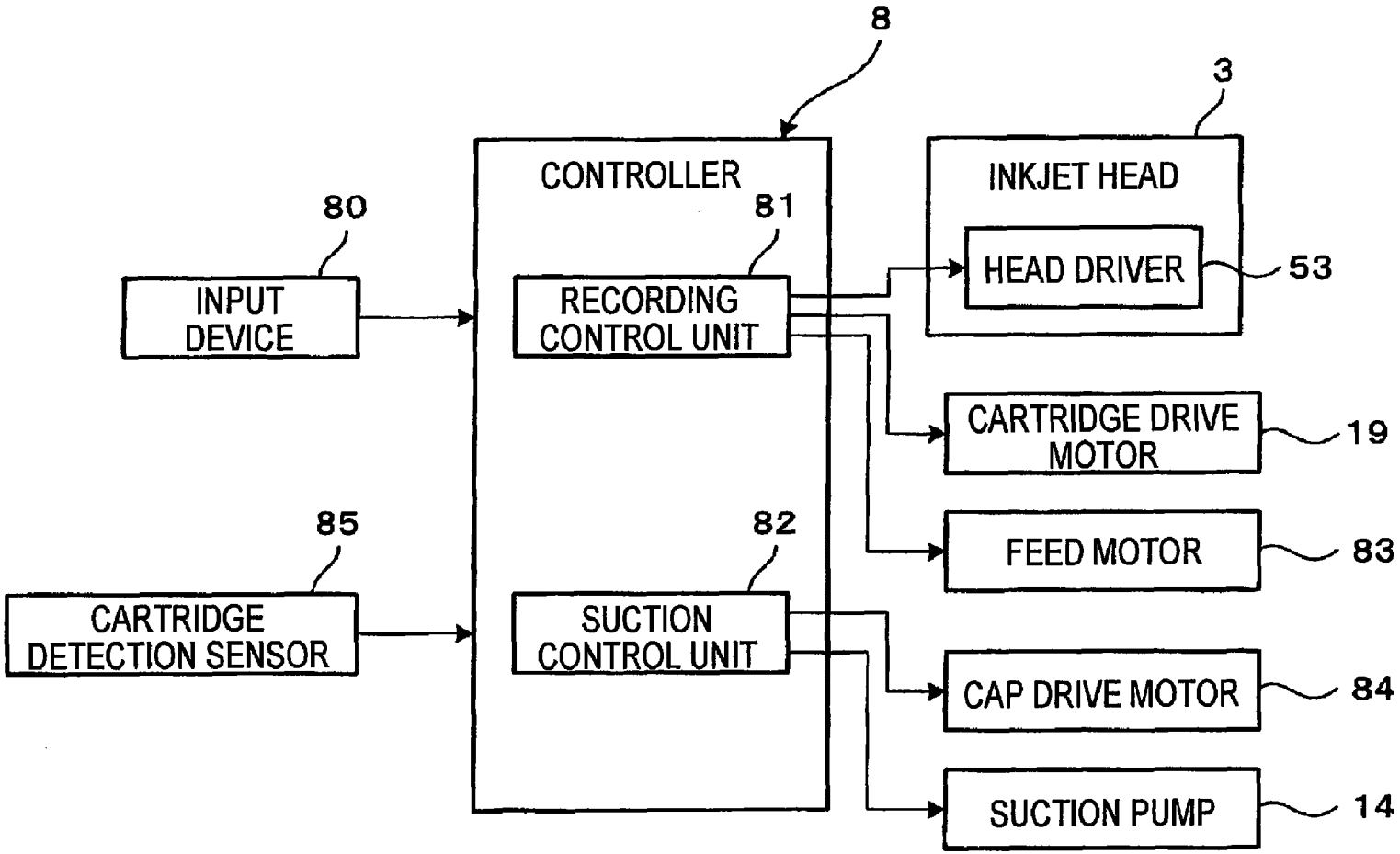
FIG. 5 is a block diagram showing a configuration of the printer of FIG. 1.

Each of ink cartridges 6*a*-6*d* may store ink of a different color, such as black, cyan, magenta, and yellow. Ink cartridges 6*a*-6*d* may be removably mounted to a holder 7. Holder 7 may comprise a cartridge detection sensor 85, as shown in FIG. 5, configured to detect whether ink cartridges 6*a*-6*d* are mounted to holder 7. Cartridge detection sensor 85 may comprise an optical sensor comprising a light-emitting device and a light-receiving device or a contact sensor. The optical sensor may detect ink cartridges 6*a*-6*d* when ink cartridges 6*a*-6*d* mounted to holder 7 interrupt the light emitted from the light-emitting device toward the light-receiving device. The contact sensor may detect ink cartridges 6*a*-6*d* when a contact portion positioned on holder 7 contacts a contact portion positioned on ink cartridges 6*a*-6*d* to have continuity therebetween.

Four colors of ink stored in ink cartridges 6*a*-6*d* may be temporarily stored in corresponding sub-tanks 4*a*-4*d* and then may be supplied to inkjet head 3. Sub-tanks 4*a*-4*d* and tubes 5*a*-5*d* connecting four sub-tanks 4*a*-4*d* to ink cartridges 6*a*-6*d* may comprise a fluid supply passage through which ink is supplied to inkjet head 3.

Suction cap 13 may be positioned at a maintenance position, which corresponds to a portion (right side in FIG. 1) of a carriage 2 movement area in the scanning direction outside a print area where carriage 2 faces recording sheet P. When carriage 2 moves to the maintenance position, suction cap 13 may face a lower surface of inkjet head 3, i.e., a fluid ejection surface having a plurality of nozzles 40 formed therein. A cap drive motor 84, as shown in FIG. 5, may drive suction cap 13 upward to cover nozzles 40 of inkjet head 3.

Suction cap 13 may be coupled to a suction pump 14 via a switching unit 15. When suction pump 14 is driven with suction cap 13 covering nozzles 40, ink may be suctioned or purged from nozzles 40. Thus, ink in nozzles 40 thickened due to drying may be purged or air in an ink passage in inkjet head 3 or in sub-tank 4, which is positioned upstream of the inkjet head 3 in an ink flow direction, may be purged from nozzles 40 together with ink. Consequently, fluid ejection performances of inkjet head 3 may be recovered.

Suction cap 13 may comprise a first cap 13*a* configured to cover nozzles 40 corresponding to black ink, and a second cap 13*b* configured to cover nozzles 40 corresponding to cyan ink, magenta ink, and yellow ink. First cap 13*a* and second cap 13*b* may be separated from each other. First cap 13*a* and second cap 13*b* may be coupled to switching unit 15 via tubes 11*a* and 11*b*, respectively. Switching unit 15 may be coupled to suction pump 14. Switching unit 15 may switch between first cap 13*a* and second cap 13*b* to selectively suction ink from nozzles 40 that eject black ink therethrough and nozzles 40 that eject cyan ink, magenta ink, and yellow ink therethrough.

Referring to FIG. 2, inkjet head 3 may comprise a passage unit 22 and a piezoelectric actuator 23. Passage unit 22 may comprise an ink flow path comprising nozzles 40 and pressure chambers 34. Piezoelectric actuator 23 may apply pressure to ink in pressure chambers 34 to eject ink from nozzles 40 of passage unit 22.

Passage unit 22 may comprise a cavity plate 30, a base plate 31, a manifold plate 32 comprising a metal material, such as stainless steel, and a nozzle plate 33 comprising insulating material, such as high polymer synthetic resin material, e.g., polyimide. Plates 30-33 may be laminated and bonded to each other.

Cavity plate 30 may have pressure chambers 34 formed therein. Pressure chambers 34 may be arranged in a direction perpendicular to the sheet of FIG. 2. Base plate 31 may have communication openings 35 and 36 which communicate with respective pressure chambers 34. Manifold plate 32 may have manifold 37 which communicates with pressure chambers 34 via communication openings 35, and communication openings 39 which communicate with respective communication openings 36. Nozzle plate 33 may have nozzles 40 formed therein. Nozzles 40 may be positioned in correspondence with pressure chambers 34 in a direction perpendicular to the sheet of FIG. 2. Passage unit 22 may comprise a plurality of individual ink passages 41 leading from manifold 37 to each nozzle 40 via corresponding pressure chamber 34.

Piezoelectric actuator 23 may comprise a metal vibration plate 50 bonded to the upper surface of passage unit 22 to cover pressure chambers 34, a piezoelectric layer 51 positioned on the upper surface of vibration plate 50, and a plurality of individual electrodes 52 formed on the upper surface of piezoelectric layer 51.

Metal vibration plate 50 may be maintained at ground potential by a head driver 53. Piezoelectric layer 51 may comprise a piezoelectric material having a main component of lead zirconate titanate (PZT), which is a ferroelectric substance and is a solid solution of lead titanate and lead zirconate. Piezoelectric layer 51 may extend over the plurality of pressure chambers 34 on the upper surface of vibration plate 50. Individual electrodes 52 may be positioned at locations opposed to the middle portion of corresponding pressure chambers 34 on the upper surface of the piezoelectric layer 51. Head driver 53 may selectively apply the ground potential or a predetermined drive potential different from the ground potential to individual electrodes 52.

When ink is ejected from nozzle 40, head driver 53 may apply drive potential to individual electrode 52 corresponding to pressure chamber 43 communicating with nozzle 40. A potential difference may occur between individual electrode 52 to which drive potential is applied and vibration plate 50 maintained at ground potential. An electric filed may be generated in a portion of piezoelectric layer 51 interposed between individual electrode 52 and vibration plate 50. The electric filed may be generated in a direction parallel to the thickness direction of piezoelectric layer 51. When the polarization direction of piezoelectric layer 51 is the same direction as the direction in which the electric field is generated, piezoelectric layer 51 may expand in its thickness direction and may contract in its plane direction perpendicular to the thickness direction of piezoelectric layer 51. Unimorph deformation may occur, due to deformation of piezoelectric layer 51, such that a portion of vibration plate 50 opposing pressure chamber 34 deforms in a convex shape curving toward pressure chamber 34. At this time, a volumetric capacity of pressure chamber 34 may decrease, such that the ink pressure in pressure chamber 34 may increase. Thus, ink may be ejected from nozzle 40 communicating with pressure chamber 34.

Figure 3:
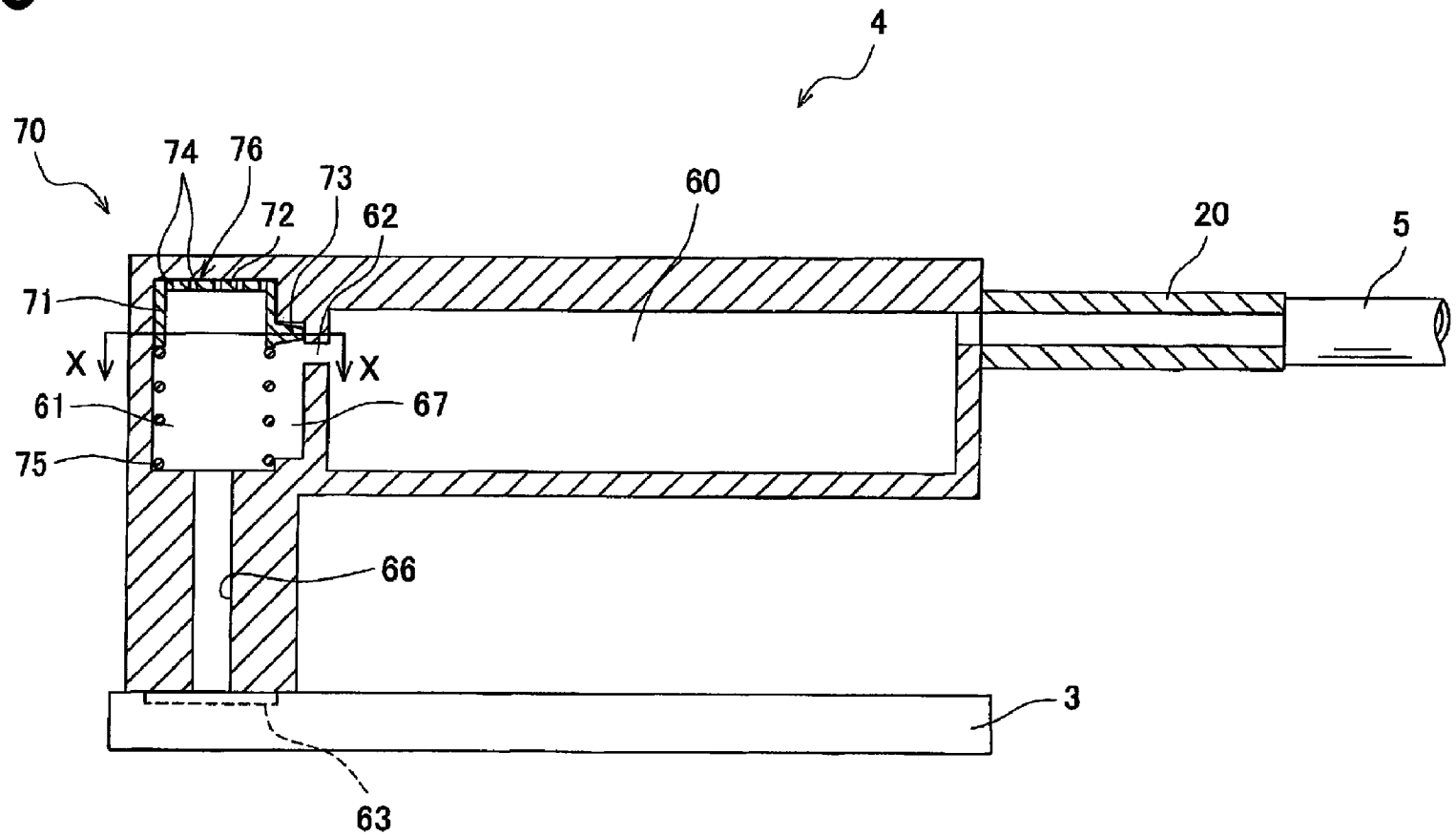
FIG. 3 is a vertical, sectional view of a sub-tank of the printer of FIG. 1, according to an embodiment of the present invention.
Figure 4:
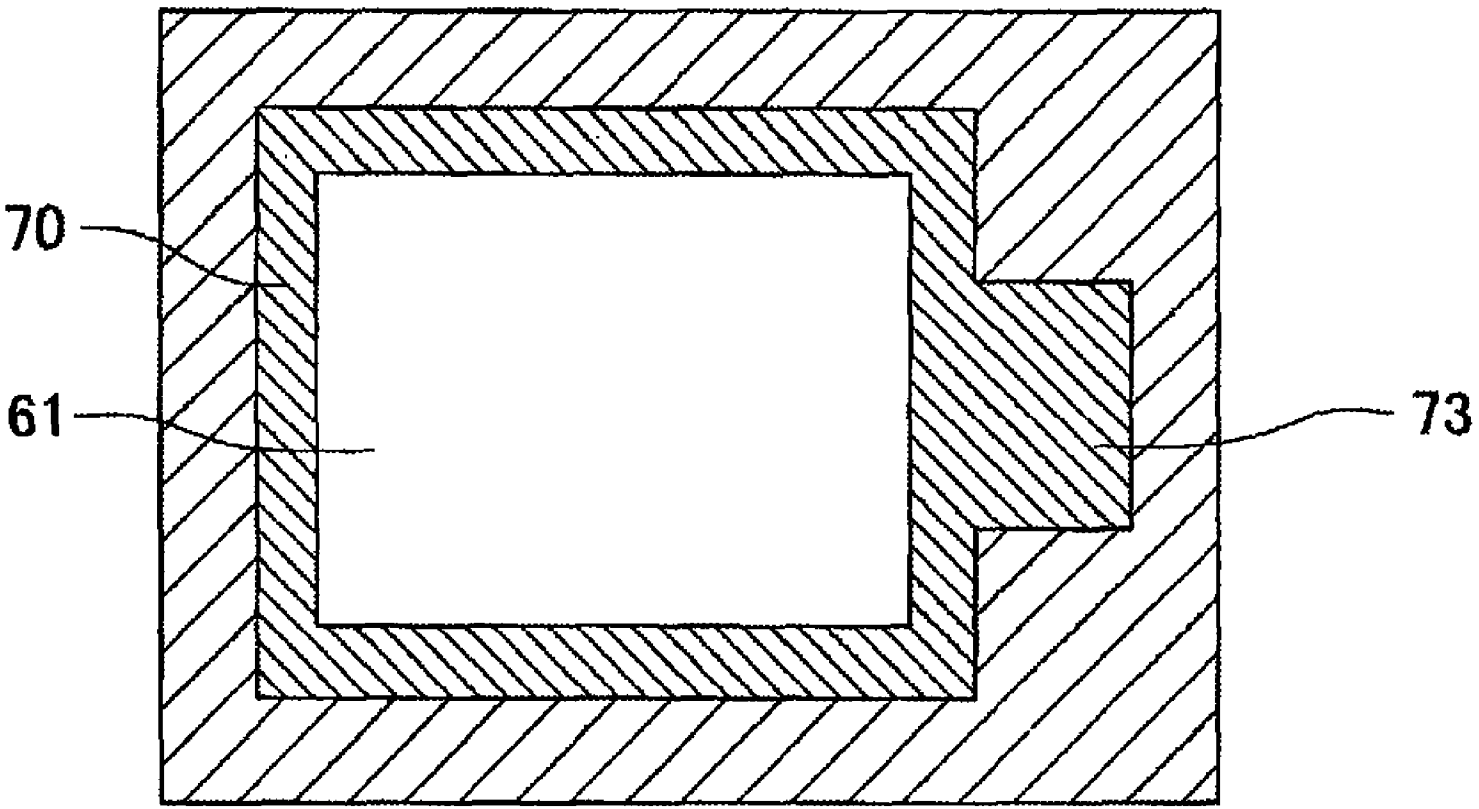
FIG. 4 is a sectional view of the sub-tank of FIG. 3 taken along line X-X.

Referring to FIGS. 3 and 4, sub-tanks 4*a*-4*d* are configured to supply ink to inkjet head 3, and sub-tanks 4*a*-4*d* may have substantially the same structure. Referring to FIG. 3, sub-tank 4 may comprise a synthetic resin material. Sub-tank 4 may comprise an ink storage chamber 60 extending in a horizontal direction, and a vertical passage 61 extending in a vertical, e.g., up-down, direction. Vertical passage 61 may communicate with ink storage chamber 60 and inkjet head 3.

Ink storage chamber 60 may communicate with ink cartridge 6 via tube 5 coupled to tube joint 20, and temporarily may store ink supplied from ink cartridge 6. An outlet of ink storage chamber 60 may be positioned slightly lower than an upper end 76 of vertical passage 61, and may communicate with vertical passage 61 via horizontal communication passage 62. A space adjacent to upper end 76 of vertical passage 61, which is positioned at a portion of the fluid supply passage, may function as a corner portion when the direction of the ink flow bends from the horizontal direction from the ink storage chamber 60 toward vertical passage 61 via communication passage 62, to the downward direction in the vertical passage 61. Upper end 76 of vertical passage 61 may function as a wall surface defining the space of the corner portion.

A connection 66 may be positioned below vertical passage 61. Connection 66 may be connected at its lower end to inkjet head 3. A filter 63 configured to remove dust from the ink flowing from sub-tank 4 toward inkjet head 3 may be positioned at the joint between the inkjet head 3 and sub-tank 4, i.e., connection 66.

A recess 67 may be formed in a wall which partitions vertical passage 61 and ink storage chamber 60. A space in recess 67 may communicate with vertical passage 61.

Ink supplied from ink cartridge 6 to sub-tank 4 via tube 5 may be temporarily stored in ink storage chamber 60. Thereafter, ink may flow in the horizontal direction from the outlet of ink storage chamber 60 toward vertical passage 61. Then, ink may flow downward in vertical passage 61 and pass through filter 63. Thus, ink may be supplied to inkjet head 3.

A movable member 70 and a coil spring 75 may be positioned in vertical passage 61.

Printer 1 may be configured to draw ink from nozzles 40 formed on the lower surface of inkjet head 3 using suction pump 14, with nozzles 40 covered with suction cap 13, to discharge air present in sub-tank 4 together with ink from nozzles 40.

When ink is drawn using suction pump 14, movable member 70 may separate air from upper end 76 of vertical passage 61, and then may move to the downstream side of vertical passage 61 in the ink flow direction due to the suction force, while holding the air. Coil spring 75 may be positioned below movable member 70 to urge movable member 70 upward. Movable member 70 may be placed in a standby position e.g., a position corresponding to the corner portion, while being pressed against upper end 76 due to buoyancy, when suction pump 14 does not perform the suctioning operation.

Referring to FIGS. 3 and 4, movable member 70 may comprise a synthetic resin material, and may have a substantially rectangular shape in horizontal cross-sectional, similar to vertical passage 61. Alternatively, movable member 70 may have a multi-angular shape. Movable member 70 may comprise a tubular portion 71 configured to slide along the inner wall of vertical passage 61, and a ceiling portion 72 positioned at an upstream end of tubular portion 71 in the ink flow direction. Movable member 70 may be slidably moved upward or downward in vertical passage 61. When movable member 70 is in the standby position, tubular portion 71 may extend in the vertical direction from upper end 76 to the position of communication passage 62. Ceiling portion 72 may have a plurality of holes 74 that pass through ceiling portion 72 in its thickness, i.e., vertical, direction. Holes 74 may be uniformly formed on a surface of ceiling portion 72 up to a portion adjacent to the outer edges of ceiling portion 74. The diameter of each hole 74 may correspond to a size which allows ink to pass therethrough and to prevent a gas meniscus from being damaged i.e., prevent gas from passing through holes 74.

Figure 6A:
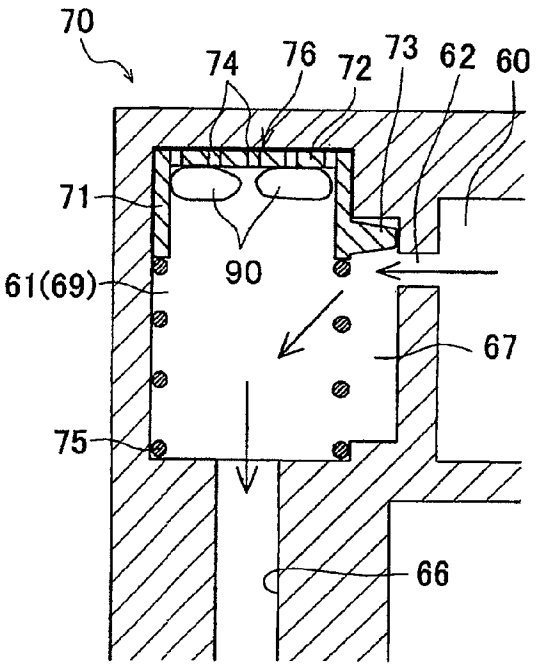
FIGS. 6A-6C are sectional views of a portion of the sub-tank of FIG. 3 showing the movements of a movable member during a suction operation with a suction pump.

Movable member 70 may comprise a switching portion, e.g., a rib 73, which extends from the lower end of tubular portion 71 and is configured to be received recess 67. The width of rib 73 may be substantially the same as the distance between the inner walls of recess 67. Rib 73 may be configured to slidably move along the inner walls of recess 67. When movable member 70 is positioned adjacent to upper end 76, rib 73 may be positioned above communication passage 62. When rib 73 is positioned above communication passage 62, ink flowing in the horizontal direction from ink storage chamber 60 toward vertical passage 61 via communication passage 62 may enter a downstream-side space of vertical passage 61 in the ink flow direction, e.g., a second space 69, as shown in FIG. 6A.

Figure 6B:
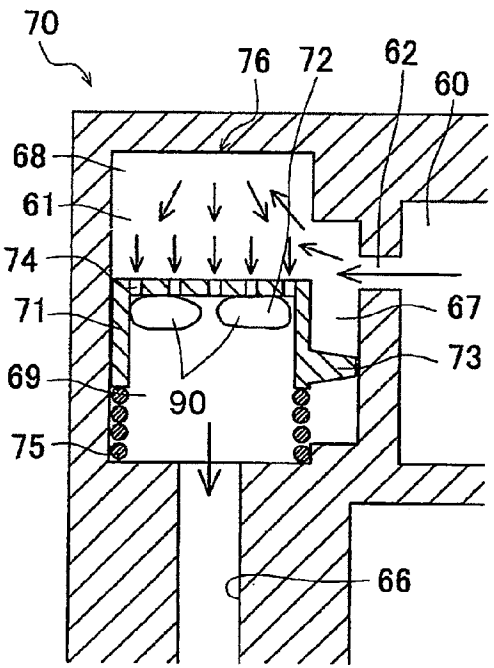
Figure 6C:
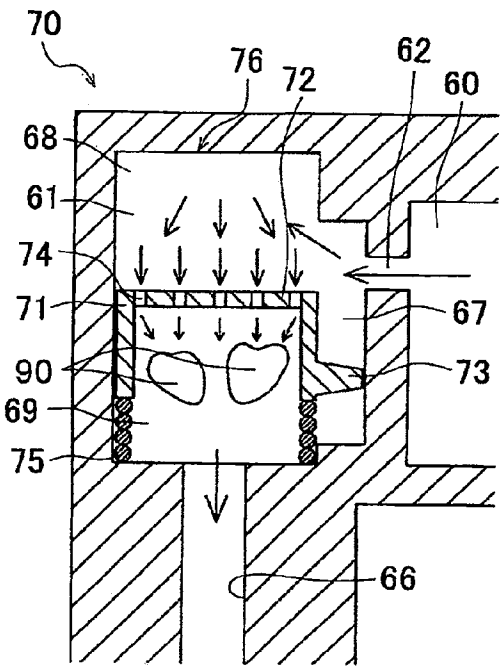

When movable member 70 moves away from upper end 76 to the downstream side in the ink flow direction and rib 73 is positioned below communication passage 62, ink flowing in the horizontal direction from ink storage chamber 60 to vertical passage 61 via communication passage 62 may enter a space of vertical passage 61 positioned between upper end 76 and an upstream end of movable member 70 in the ink flow direction, e.g., a first space 68, as shown in FIGS. 6B and 6C.

Movable member 70 may be configured to partition vertical passage 61 into first space 68 and second space 69. First space 68 and second space 69 may communicate with each other via holes 74. When movable member 70 positioned at the standby position, e.g., at the corner portion of vertical passage 61, adjacent to upper end 76, rib 73 may close a portion of the fluid supply passage from ink storage chamber 60 to first space 68, to lead ink toward second space 69. As shown in FIG. 3, first space 68 substantially may not exist in vertical passage 61 when movable member 70 is positioned at the corner portion of vertical passage 61. When rib 73 is positioned below communication passage 62 as movable member 70 moves away from upper end 76, rib 73 may close a portion of the fluid supply passage from ink storage chamber 60 to second space 69, to lead ink toward first space 68.

Referring to FIG. 5, a controller 8 configured to perform overall control of printer 1 is depicted. Controller 8 may comprise a central processing unit (CPU), a read only memory (ROM) that stores programs and data to control overall operations of printer 1, and a random access memory (RAM) which temporarily stores data that the CPU processes.

Controller 8 further may comprise a recording control unit 81 and a suction control device, e.g., a suction control unit 82. Recording control unit 81 may control e.g., a carriage drive motor 19 which drives carriage 2 to reciprocatingly move, head driver 53 for inkjet head 3, and a feed motor 83 of the sheet conveying mechanism (not shown) which conveys recording sheets P, to form an image, e.g., text, on recording sheets P, based on data input from an input device 80, e.g., a personal computer. Suction control unit 82 may control e.g., a cap drive motor 84 which drives suction cap 13 to move up and down and suction pump 14 to perform an ink suction operation to draw or purge ink from nozzles 40 of inkjet head 3.

Referring to FIGS. 6A-6C, operations of movable member 70 are discussed. When the ink suction operation with suction pump 14 is not performed, movable member 70 may be pressed against upper end 76 by coil spring 78, such that movable member 70 is positioned hi a space of vertical passage 61 at the corner portion, as shown in FIG. 6A, in which movable member 70 is positioned above the outlet of ink from ink storage chamber 60, i.e., communication passage 62. Therefore, air 90 trapped in the fluid supply passage leading from ink cartridge 6 to inkjet head 3 may float due to buoyancy and may tend to accumulate at the underside of ceiling portion 72 of movable member 70 positioned at upper end 76. When rib 73 is positioned above communication passage 62, the fluid resistance in the fluid supply passage leading to second space 69 is less than the fluid resistance in the fluid supply passage leading to first space 68. Therefore, ink flowing in the horizontal direction from ink storage chamber 60 toward vertical passage 61 via communication passage 62 may enter second space 69 and flow toward inkjet head 3.

When the ink suction operation is performed with suction pump 14, pressures in a portion of vertical passage 61 downstream of movable member 70 in the ink flow direction may be reduced. Therefore, movable member 70 may move away from upper end 76 in the downstream side in the ink flow direction, as shown in FIG. 6B. A condition in which movable member 70 moves away from upper end 76 in the downstream side in the ink flow direction may be ($P \times S > F + C1 + C2$), in which P is the drawing pressure applied by suction pump 14 to a portion of vertical passage 61 downstream of movable member 70 in the ink flow direction; S is the horizontal sectional area of ceiling portion 71; F is the urging force of coil spring 75; C1 is the buoyancy applied to movable member 70; and C2 is the buoyancy applied to air accumulated at the underside of ceiling portion 72. In other words, when force $P \times S$ to move or pull movable member 70 downward or toward the downstream side in the ink flow direction becomes greater than the force $F + C1 + C2$ to move or push movable member 70 upward or toward the upstream side in the ink flow direction, movable member 70 may move away from upper end 76 in the downstream side in the ink flow direction.

When movable member 70 moves away from upper end 76 toward the downstream side in the ink flow direction, movable member 70 may separate air 90 from upper end 76. Further, movable member 70 may move in the downstream side in the ink flow direction while holding air 90 at the underside of ceiling portion 72. Movable member 70 may comprise tubular portion 71 having a cylindrical shape, and ceiling portion 72 connected thereto. Therefore, when movable member 70 moves in the downstream side in the ink flow direction during the ink suction operation with suction pump 14, movable member 70 reliably may hold air 90.

When movable member 70 moves in the downstream side in the ink flow direction while holding air 90 at the underside of ceiling portion 72, rib 73 may be positioned below communication passage 62. At this time, fluid resistance in the fluid supply passage leading to first space 68 may become less than the fluid resistance in the fluid supply passage leading to second space 69. Therefore, ink flowing in the horizontal direction from ink storage chamber 60 toward vertical passage 61 via communication passage 62 may enter first space 68.

Ink flowing into first space 68 may push movable member 70 toward the downstream side in the ink flow direction, such that a force U to push movable member 70 toward the downstream side in the ink flow direction may be applied to movable member 70. The relationship of the force to move movable member 70 in the upstream side in the ink flow direction to the force to move movable member 70 in the downstream side in the ink flow direction may be expressed as $(P+U) \times S > F + C1 + C2$.

While the ink suction operation continuously is performed, coil spring 75 may be compressed to its compression limit, and movable member 70 may stop on the upper end of connection 66 via coil spring 75. If the ink suction operation is further continued with movable member 70 on the upper end of connection 66, ink may flow into second space 69 from first space 68 via holes 74 formed on ceiling portion 72. Ink thus flowing into second space 69 may move or push air 90 held at ceiling portion 72 toward the downstream side in the ink flow direction. Holes 74 may be formed on a surface of ceiling portion 72 up to a portion adjacent to its outer edges, such that ink flowing from first space 68 to second space 69 through holes 74 may separate and push air 90 clingingly adhered to a corner portion defined by tubular portion 71 and ceiling portion 72, toward the downstream side in the ink flow direction.

Air 90 moved to the downstream side in the ink flow direction may be pulled toward inkjet head 3. Air 90 may pass through the ink passage in inkjet head 3 and may be discharged from nozzles 40. Thus, movable member 70 may separate air 90 from upper end 76 during the ink suction operation. Then, air 90 may be moved smoothly in the downstream side in the ink flow direction and discharged from nozzles 40. With this configuration, an amount of ink discharged from nozzles 40 to discharge air 90 may be reduced.

When the ink suction operation is performed with suction pump 14 and with air being present in sub-tank 4, air in sub-tank 4 may not reach inkjet head 3 if a volume of ink suctioned by suction pump 14 is relatively small, e.g., an amount of time during which ink is suctioned by suction pump 14 is relatively short. As the ink suction operation is completed, air that has not reached inkjet head 3 may move upward in the ink flow direction. Suction control unit 82 may change ink suction volumes by suction pump 14, such that suction pump 14 performs the ink suction operation selectively in a first suction mode and in a second suction mode in which the ink suction volume is greater than the ink suction volume in the first mode.

When ink droplets are not ejected from nozzles 40 for a relatively long period of time, ink in the ink passage, e.g., nozzles 40, of inkjet head 3 may thicken due to drying. If ink thickens, ink may not properly be ejected from nozzles 40 to recording sheets P to form an image on recording sheets P.

When ink droplets are not ejected from nozzles 40 for a predetermined period of time, suction control unit 82 may select the first suction mode to allow suction pump 14 perform the ink suction operation in the first suction mode to suction ink in the ink passage of inkjet head 3 from nozzles 40. Thus, thickened ink may be discharged from nozzles 40. More specifically, recording control unit 81 may control carriage drive motor 19 to move carriage 2 and inkjet head 3 to the maintenance position where inkjet head 3 faces suction cap 13. Suction control unit 82 may control cap drive motor 84 to raise suction cap 13 and cover nozzles 40 of inkjet head 3 with suction cap 13. Suction pump 14 may perform drawing of a relatively small ink volume, e.g., by performing the ink suction operation for relatively short period of time, to discharge only ink in inkjet head 3. The ink suction volume in the first suction mode may be less than the volumetric capacity of the movable range of movable member 70 in vertical passage 61, e.g., from upper end 76 to a position closest to the upper end of connection 66 via coil spring 75, when coil spring 75 is compressed at its compression limit. Therefore, movable member 70 may not reach the most downstream portion in its movable range, e.g., a position closest to the upper end of connection 66 via coil spring 75, during the ink suction operation. Air that is moved by movable member 70 in the downstream side in the ink flow direction may not enter inkjet head 3. Only thickened ink in inkjet head 3 may be discharged or purged from nozzles 40.

Air may enter the fluid supply passage from ink cartridge 6 to inkjet head 3 including sub-tank 4, due to various factors. For example, when ink cartridge 6 is replaced with a new ink cartridge 6, air readily may enter the fluid supply passage from an end of tube 5 which is coupled to ink cartridge 6. Air gradually may enter from a joint between sub-tank 4 and tube 5 over a relatively long period of time. Air thus entering the fluid supply passage may be accumulated at the upper end 76 due to buoyancy and increase its size. If air flows into inkjet head 3 together with ink from sub-tank 4, ink droplets may not properly be ejected from inkjet head 3.

When cartridge detection sensor 85 detects that ink cartridge 6 is replaced with a new one, or it is determined that air is not discharged from sub-tank 4 for a relatively long period of time, suction control unit 82 may select the second section mode to allow suction pump 14 perform the ink suction operation in the second suction mode to discharge air and ink in sub-tank 4 from nozzles 40.

More specifically, suction control unit 82 may control cap drive motor 84 to raise suction cap 13 and cover nozzles 40 of inkjet head 3 with suction cap 13, similar to the ink suction operation in the first suction mode. Suction pump 14 may perform the ink suction operation. At this time, the volume of ink suctioned from nozzles 40 may be greater than the volumetric capacity of the movable range of movable member 70 in vertical passage 61. Movable member 70 may move to connection 66 and air may be moved toward inkjet head 3 in the downstream side in the ink flow direction while suction pump 14 performs the ink suction operation. Air may be drawn inside print head 3 together with ink as the ink suction operation is further continued. Air may be discharged from nozzles 40 through the ink passage in inkjet head 3.

When the ink suction operation with suction pump 14 is not performed, movable member 70 may remain at upper end 76. At this time, ink flowing from ink storage chamber 60 may flow into second space 69 positioned downstream of movable member 70 in the ink flow direction. Even when gas is held by movable member 70, the gas may not be caught in the ink flow from ink storage chamber 60 to second space 69, and may not be moved in the downstream side in the ink flow direction. When the ink suction operation with suction pump 14 is performed, the pressure in a portion of vertical passage 61 downstream of movable member 70 may be reduced, such that movable member 70 may separate the gas from upper end 76 and move in the downstream side in the ink flow direction while holding the gas.

Movable member 70 may have holes 74 which allow first space 68 and second space 69 to communicate with each other. Therefore, when movable member 70 moves in the downstream side in the ink flow direction, ink may flow from first space 68 to second space 69 through holes 74. Ink flowing from first space 68 to second space 69 through holes 74 may push the gas held by movable member 70 in the downstream side in the ink flow direction. Thus, the gas smoothly may be moved in the downstream side in the ink flow direction and discharged from nozzles 40 during the ink suction operation. Accordingly, an amount of ink discharged may be reduced.

In another embodiment of the present invention, movable member 70 may comprise a foaming synthetic resin material having a specific gravity which is less than the specific gravity of ink. In this case, movable member 70 may be pressed against upper end 76 due to buoyancy, such that coil spring 77 may be unnecessary. The condition to move movable member 70 away from upper end 76 in the downstream side in the ink flow direction may be ($P \times S > C1 + C2$). In other words, when force $P \times S$ to move or pull movable member 70 downward or toward the downstream side in the ink flow direction becomes greater than the force $C1 + C2$ to move or push movable member 70 upward or toward the upstream side in the ink flow direction, movable member 70 may move away from upper end 76 in the downstream side in the ink flow direction.

Rib 73 may switch the space into which ink flowing from ink storage chamber 60 enters, between first space 68 and second space 69. Nevertheless, in another embodiment of the present invention, movable member 70 may not comprise rib 73. As movable member 70 is moved in the downstream side in the ink flow direction during the ink suction operation with suction pump 14, fluid resistance in the fluid supply passage leading to first space 68 gradually may reduce, and fluid resistance in the fluid supply passage leading to second space 69 gradually may increase. Therefore, ink may tend to enter first space 68. A space into which ink flowing out from ink storage chamber 60 enters smoothly may be switched from second space 69 to first space 68.

Further, in yet another embodiment of the present invention, movable member 70 may not comprise tubular portion 71. For example, the lower surface (downstream surface in the ink flow direction) of movable member 70 may be convex and may curve more greatly toward the downstream side in the ink flow direction with respect to the horizontal plane perpendicular to the direction in which vertical passage 61 extends as the distance from a middle portion of movable member 70 toward its periphery increases. With this configuration, air positioned downstream of movable member 70 in the ink flow direction may float up due to buoyancy, and reliably may be held on the underside of moveable member 70.

Ceiling portion 72 may be positioned to cover the uppermost end of tubular portion 71. Nevertheless, in yet another embodiment of the present invention, ceiling portion 72 may be positioned below the uppermost end of tubular portion 71. In this configuration, movable member 70 may have a cross section of generally a H-shape in vertical sectional view of sub-tank 4. When movable member 70 is placed in the standby position, e.g., the corner portion of vertical passage 61, a space, e.g., first space 68, may exist between upper end 76 and ceiling portion 72.

The above-described embodiments of the present invention may be applied to an inkjet printer configured to form, e.g., an image on recording sheet P by ejecting ink. Nevertheless, the above-described embodiment of the present invention also may be applied to other types of fluid ejection apparatus that eject fluid of various types to an ejection object according to usages.

While the invention has been described in connection with various exemplary structures and illustrative embodiments, it will be understood by those skilled in the art that other variations and modifications of the structures and embodiments described above may be made without departing from the scope of the invention. Other structures and embodiments will be apparent to those skilled in the art from a consideration of the specification or practice of the invention disclosed herein. It is intended that the specification and the described examples are illustrative with the true scope of the invention being defined by the following claims.

What is claimed is:

1. A fluid ejection apparatus, comprising:

a fluid ejection head comprising a nozzle through which fluid is ejected;

a fluid supply passage through which fluid is supplied to the fluid ejection head;

a suction device configured to draw fluid from the nozzle; and a movable member positioned within a predetermined portion of the fluid supply passage;

wherein the movable member has at least one opening formed therethrough, and is configured to hold at least one air bubble therein;

wherein the movable member is configured to move between a first position and a second position downstream of the first position in a fluid flowing direction;

wherein, when the movable member is in the second position, the movable member partitions the predetermined portion of the fluid supply passage into a first space upstream of the movable member and a second space downstream of the movable member; and wherein when the suction device transitions from an inactive state to an active state to draw fluid from the nozzle, the movable member moves from the first position to the second position and remains in the second position until the suction device transitions from the active state to the inactive state.

2. The fluid ejection apparatus of claim 1, wherein, when the movable member is in the second position, the first space is in fluid communication with the second space via the at least one opening, and fluid entering the predetermined portion of the fluid supply passage flows into the first space before entering the second space via the at least one opening.

3. The fluid ejection apparatus of claim 2, wherein the fluid enters the predetermined portion of the fluid supply passage at a predetermined location, and the first position is above the predetermined location.

4. The fluid ejection apparatus of claim 1, wherein the suction device draws fluid from the nozzle until the at least one air bubble is removed from the movable member.

5. The fluid ejection apparatus of claim 3, wherein, when the movable member is in the second position, fluid resistance in the first space is less than fluid resistance in the second space.

6. The fluid ejection apparatus of claim 5, wherein the movable member comprises a switching portion configured to guide fluid from the predetermined location toward the second space when the movable member is in the first position, and to guide fluid from the predetermined location toward the first space when the movable member is in the second position.

7. The fluid ejection apparatus of claim 1, further comprising an urging member configured to urge the movable member toward the first position.

8. The fluid ejection apparatus of claim 1, wherein the predetermined portion of the fluid supply passage extends vertically, and the movable member is positioned at the first position by buoyancy.

9. The fluid ejection apparatus of claim 1, wherein the movable member comprises a peripheral portion and a middle portion, and the peripheral portion extends further downstream in the fluid flowing direction than the middle portion extends downstream in the fluid flowing direction.

10. The fluid ejection apparatus of claim 1, wherein the movable member comprises a tubular portion and a ceiling portion, and the tubular portion extends further downstream in the fluid flowing direction than the ceiling portion extends downstream in the fluid flowing direction.

11. The fluid ejection apparatus of claim 10, wherein, when the movable member is in the first position, the ceiling portion is positioned at an upstream end of the predetermined portion of the fluid supply passage in the fluid flowing direction.

12. The fluid ejection apparatus of claim 10, wherein the ceiling portion has the at least one opening formed therethrough.

13. The fluid ejection apparatus of claim 12 wherein at least one of the at least one opening is formed adjacent to a corner portion defined by the tubular portion and the ceiling portion.

14. The fluid ejection apparatus of claim 1, wherein the movable member has a substantially rectangular shape corresponding to a shape of the predetermined portion of the fluid supply passage.

15. The fluid ejection apparatus of claim 1, further comprising a suction control device configured to control a volume of fluid drawn from the nozzle by selectively operating the suction device in a first suction mode in which the suction device is configured to discharge fluid from the fluid ejection head, and a second suction mode in which the suction device is configured to discharge fluid and the at least one air bubble.

16. The fluid ejection apparatus of claim 15, wherein the volume of fluid discharged in the first suction mode is less than a volumetric capacity of a movable range of the movable member, and the volume of fluid discharged in the second suction mode is greater than the volumetric capacity of the movable range of the movable member.

* * * * *